US010682030B2

(12) United States Patent
Wall et al.

(10) Patent No.: US 10,682,030 B2
(45) Date of Patent: Jun. 16, 2020

(54) UPRIGHT VACUUM CLEANER INCLUDING DEBRIS TUBE BRACES

(71) Applicant: Emerson Electric Co., St. Louis, MO (US)

(72) Inventors: Alex J. Wall, St. Louis, MO (US); Matthew A. Williams, Bridgeton, MO (US); John L. Theising, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 306 days.

(21) Appl. No.: 15/619,972

(22) Filed: Jun. 12, 2017

(65) Prior Publication Data

US 2018/0353030 A1 Dec. 13, 2018

(51) Int. Cl.

| | |
|---|---|
| ***A47L 9/04*** | (2006.01) |
| ***A47L 5/30*** | (2006.01) |
| ***A47L 9/32*** | (2006.01) |
| ***A47L 9/28*** | (2006.01) |

(52) U.S. Cl.

CPC ..... *A47L 9/0411* (2013.01); *A47L 5/30* (2013.01); *A47L 9/0444* (2013.01); *A47L 9/28* (2013.01); *A47L 9/325* (2013.01)

(58) Field of Classification Search

CPC ..... A47L 9/22; A47L 9/0411

See application file for complete search history.

(56) References Cited

U.S. PATENT DOCUMENTS

| | | | | |
|---|---|---|---|---|
| 2,633,597 | A | 4/1953 | Turner | |
| 2,980,939 | A | 4/1961 | Sparklin et al. | |
| 3,634,905 | A | 1/1972 | Boyd | |
| 5,279,018 | A * | 1/1994 | Glenn, III | A47L 9/22 15/351 |
| 5,511,282 | A * | 4/1996 | Metzger | A47L 9/22 15/351 |
| 6,006,401 | A | 12/1999 | Jailor et al. | |
| 6,401,294 | B2 | 6/2002 | Kasper | |
| 2006/0021184 | A1 | 2/2006 | Hawkins et al. | |
| 2008/0209671 | A1 * | 9/2008 | Conrad | A47L 9/04 15/389 |
| 2013/0117961 | A1 | 5/2013 | Doerfler | |
| 2014/0013537 | A1 | 1/2014 | Kasper | |

FOREIGN PATENT DOCUMENTS

DE 10336829 A1 3/2005

* cited by examiner

*Primary Examiner* — Andrew A Horton
(74) *Attorney, Agent, or Firm* — Armstrong Teasdale LLP

(57) ABSTRACT

An upright vacuum cleaner includes a cleaning head for removing debris from a floor, a debris tube connected to the cleaning head for receiving the debris, and a steering handle connected to the debris tube. The upright vacuum cleaner also includes a hinge connecting the debris tube to the cleaning head such that the debris tube rotates relative to the cleaning head. The upright vacuum cleaner further includes braces to support the debris tube as the debris tube rotates relative to the cleaning head. The braces are disposed on opposite sides of the debris tube. Each brace includes a bearing connected to the cleaning head to allow the brace to rotate relative to the cleaning head.

17 Claims, 11 Drawing Sheets

UPRIGHT VACUUM CLEANER INCLUDING DEBRIS TUBE BRACES

FIELD

The field relates to vacuum cleaners and, in particular, upright vacuum cleaners that include a pivoting debris tube and braces connected to the debris tube.

BACKGROUND

Vacuum cleaners typically include a cleaning head and a debris tube connected to the cleaning head. In at least some known vacuum cleaners, a hinge pivotably connects the debris tube to the cleaning head. The hinge supports the debris tube and components connected to the debris tube such as a battery. During operation, the hinge may experience loads due to the weight of the components and the movement of the vacuum cleaner. As a result, the hinge may fail after repeated use of the vacuum cleaner. In addition, the vacuum cleaner may be difficult to maneuver because of the loads on the hinge.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, an upright vacuum cleaner includes a cleaning head for removing debris from a floor, a debris tube connected to the cleaning head for receiving the debris, and a steering handle connected to the debris tube. The upright vacuum cleaner also includes a hinge connecting the debris tube to the cleaning head such that the debris tube rotates relative to the cleaning head. The upright vacuum cleaner further includes braces to support the debris tube as the debris tube rotates relative to the cleaning head. The braces are disposed on opposite sides of the debris tube. Each brace includes a bearing connected to the cleaning head to allow the brace to rotate relative to the cleaning head.

In another aspect, an upright vacuum cleaner includes a cleaning head for removing debris from a floor and into the vacuum cleaner, a filter assembly to filter and collect debris from an airstream, and a debris tube connected to the cleaning head and filter assembly. The upright vacuum cleaner also includes a steering handle for steering the cleaning head over the floor. The upright vacuum cleaner further includes a lift handle for lifting the vacuum cleaner from the floor. The lift handle includes a flexible strap and a rigid member. The flexible strap includes a sleeve that defines a channel within the sleeve. The rigid member extends through the channel.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
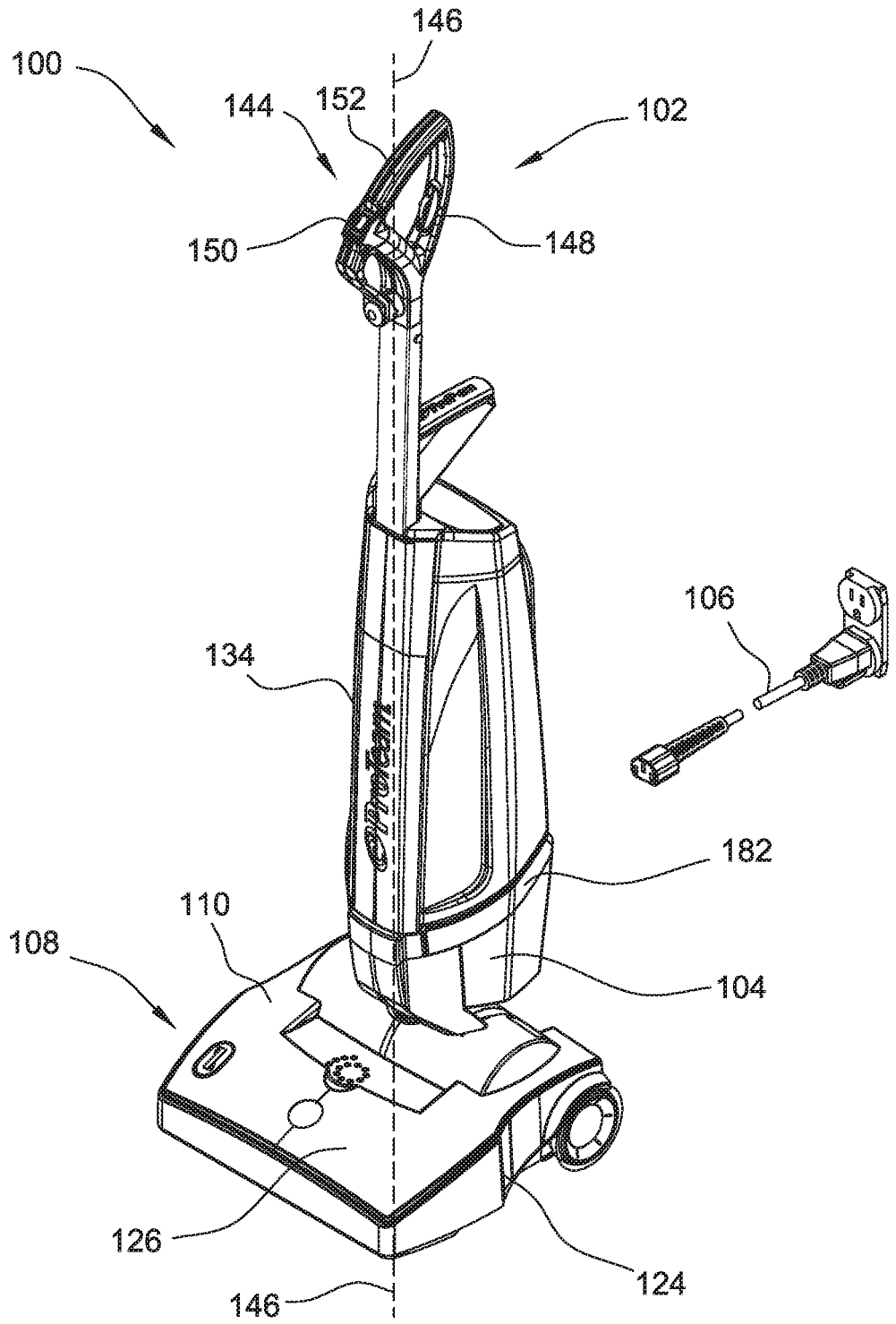
FIG. 1 is a perspective view of a vacuum cleaning system including a vacuum cleaner.

FIG. 1 is a perspective view of an example vacuum cleaning system 100. Vacuum cleaning system 100 includes a vacuum cleaner 102, a battery 104, and a power cord 106. Vacuum cleaner 102 may be connected to and receive power from battery 104 or power cord 106. Accordingly, vacuum cleaner 102 may be operated in a cordless mode and a corded mode. In other embodiments, vacuum cleaner 102 may have any configuration that enables vacuum cleaner 102 to operate as described.

Figure 2:
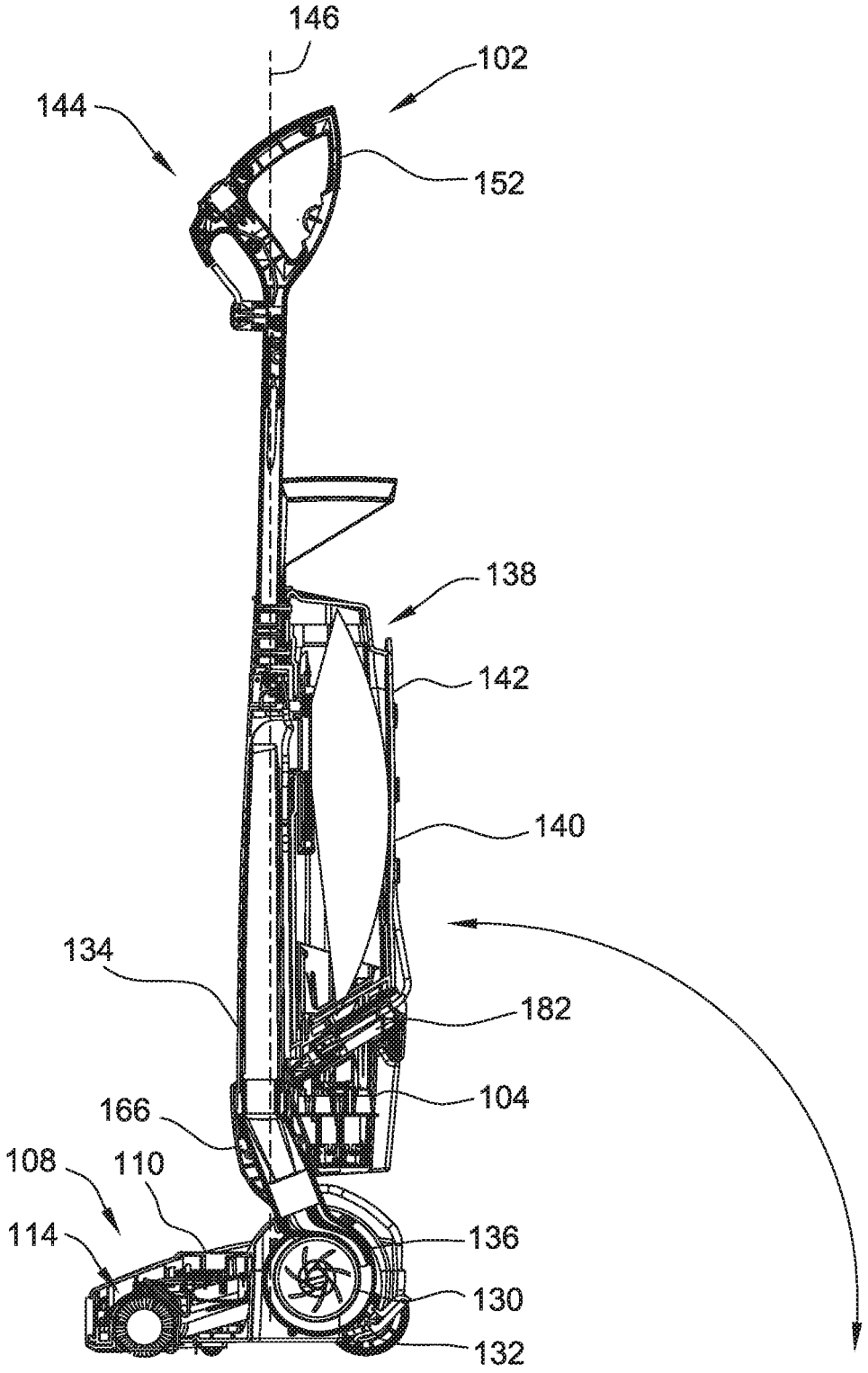
FIG. 2 is a sectional side view of the vacuum cleaner.
Figure 3:
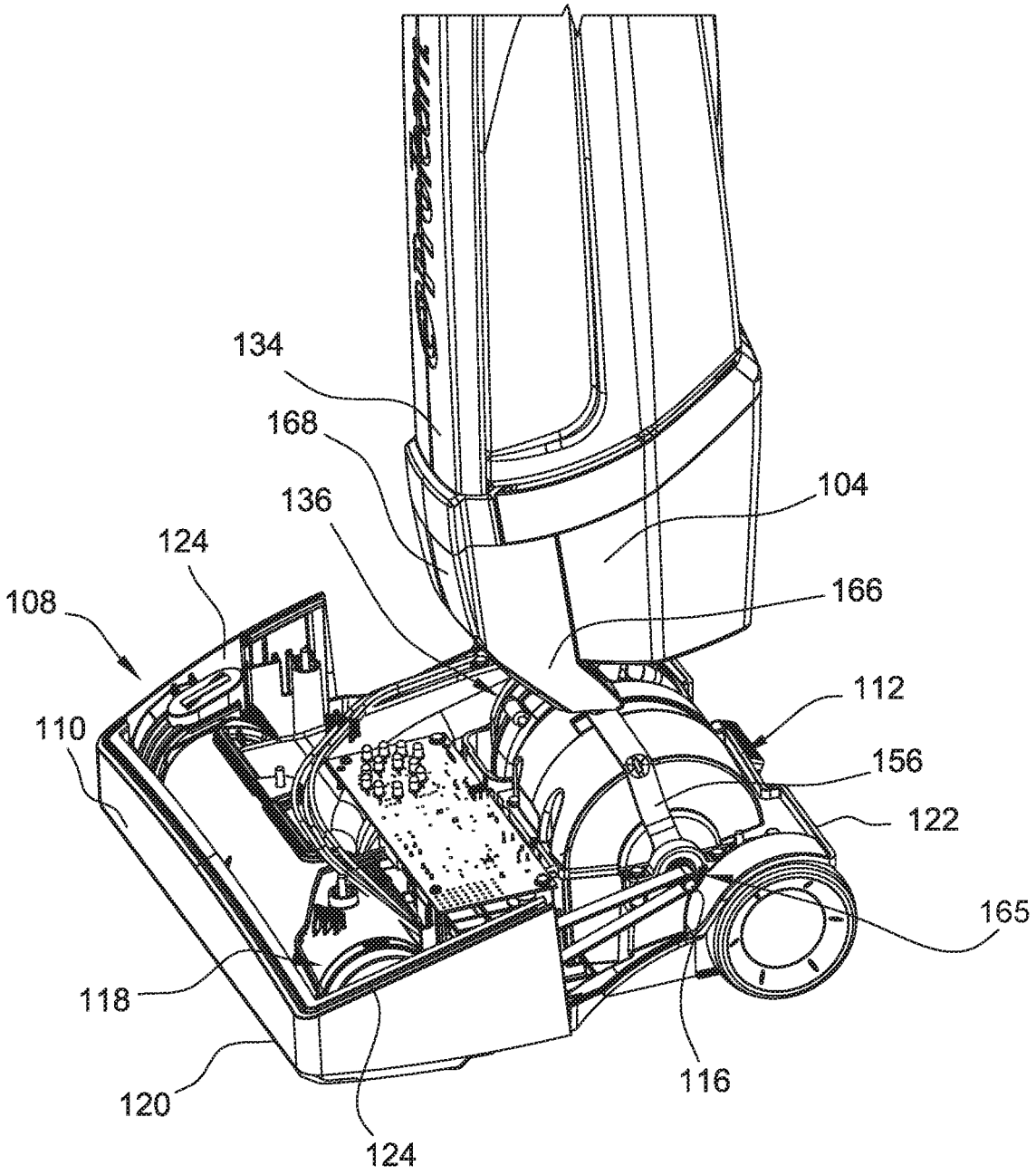
FIG. 3 is a perspective view of a cleaning head of the vacuum cleaner with a cover removed.

In reference to FIGS. 2 and 3, vacuum cleaner 102 includes a cleaning head 108 for removing debris from a floor and directing the debris into vacuum cleaner 102. Cleaning head 108 includes a housing 110, a motor assembly 112, and a rotary brush 114. Housing 110 at least partially covers motor assembly 112 and rotary brush 114. Motor assembly 112 powers rotary brush 114 which includes one or more brushes (not shown) that rotate and contact the floor to agitate debris and promote entrainment of the debris into airflow into vacuum cleaner 102. A drive shaft 116 of motor assembly 112 is operatively connected to rotary brush 114 by a pulley assembly 118 to allow motor assembly 112 to power rotary brush 114. In other embodiments, cleaning head 108 may have any configuration that enables vacuum cleaner 102 to operate as described.

Housing 110 includes a front wall 120, a rear wall 122, sidewalls 124, and a cover 126 (shown in FIG. 1). Sidewalls 124 extend between front wall 120 and rear wall 122. A width 128 of cleaning head 108 is defined between sidewalls 124. Cover 126 (shown in FIG. 1) is attached to front wall 120, rear wall 122, and sidewalls 124. In alternative embodiments, cleaning head 108 may include any housing 110 that enables vacuum cleaner 102 to operate as described herein.

A blower or fan 130 pulls air and debris from rotary brush 114, through a blower housing 132 and into blower 130. Blower 130 pushes the air and debris into a debris tube 134 that extends upward from cleaning head 108. Debris tube 134 is pivotally attached to cleaning head 108 by a hinge 136. Hinge 136 is centered between sidewalls 124 of housing 110.

Debris tube 134 is fluidly connected to blower 130 and a filter assembly 138. Air and debris travel up debris tube 134 and are discharged into filter assembly 138, where debris is filtered from the air and collected. Filter assembly 138 is disposed within a filter housing 140. Filter housing 140 may include rigid (e.g., plastic) and/or flexible (e.g., fabric) components.

In this embodiment, filter housing 140 includes an access door 142 to allow access to filter assembly 138 (e.g., to insert or remove a filter). Filter assembly 138 may include any filter that allows air to pass through and retains at least some debris within filter assembly 138. For example, in some embodiments, filter assembly 138 may include a flexible filter such as a bag filter. In other embodiments, filter assembly 138 may include a rigid filter.

In reference to FIGS. 1 and 2, a handle assembly 144 is attached to debris tube 134. Handle assembly 144 extends vertically from debris tube 134 along a longitudinal axis 146 of vacuum cleaner 102. Directions refer to the orientation of vacuum cleaner 102 shown in FIG. 1 unless stated otherwise. For example, the term "vertical" refers to a direction parallel to longitudinal axis 146. The term "horizontal" refers to a direction perpendicular to longitudinal axis 146.

Handle assembly 144 includes a cord holder 148, a power switch 150, and a steering handle 152. Power switch 150 is attached to steering handle 152 and is positionable between an ON position and an OFF position to control power to vacuum cleaner 102. In other embodiments, vacuum cleaner 102 may include any handle assembly 144 that enables vacuum cleaner 102 to operate as described.

Figure 12:
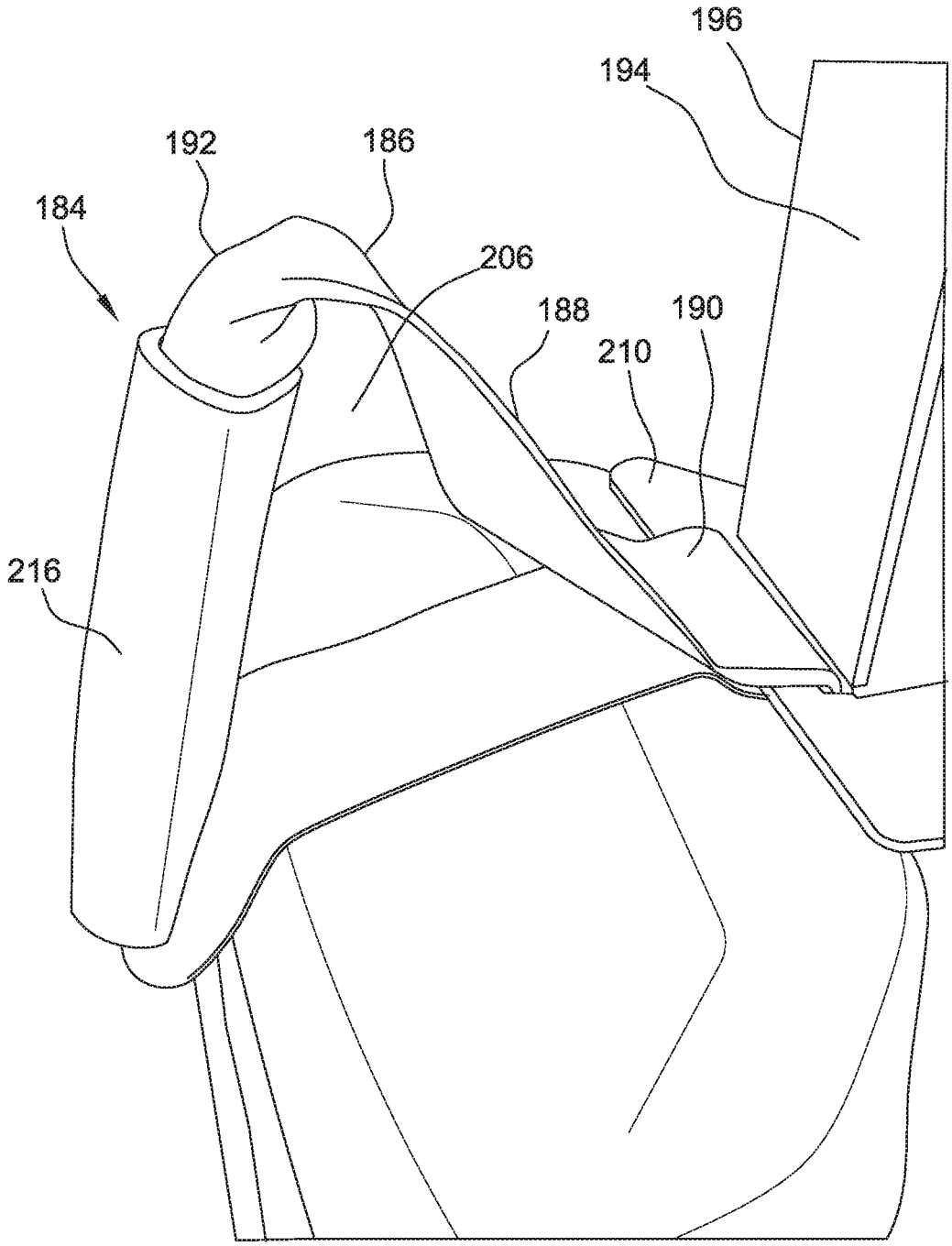
FIG. 12 is a perspective view of a lift handle of the vacuum cleaner.

In reference to FIGS. 12-15, handle assembly 144 of upright vacuum cleaner 102 includes a lift handle 184 (FIG. 12). Lift handle 184 includes a flexible strap 186. Strap 186 forms a loop 188 that defines an opening 206 to grasp lift handle 184. Strap loop 188 may be formed by connecting the two ends of strap 186 together (e.g., by stitching the two ends together). Loop 188 of the strap 186 is disposed between steering handle 152 (FIG. 2) and the filter housing 140.

Loop 188 extends from a leg 190 of strap 186. Strap leg 190 is attached to a rear side 194 of shaft 196 of handle assembly 144 by bossed fasteners 200 (FIG. 13) that mate with threaded connections 198 (FIG. 14) of handle assembly 144. Leg 190 extends through a bracket 210. Strap 186 is flexible and adapted to pivot up (such as when the vacuum cleaner is lifted) and down (such as when the lift handle is at rest) from where leg potion 190 extends through bracket 210.

Strap 186 may be made of any relatively flexible material. In some embodiments, strap 186 is made of nylon (e.g., is made of a web of nylon). In other embodiments, strap 186 may be made of materials including, for example and without limitation, leather, canvas, and synthetic materials such as polyester.

Strap 186 includes a sleeve 192 (FIG. 15) that extends along a portion of loop 188. An operator grasps lift handle 184 at sleeve 192. Strap sleeve 192 defines a channel 202 (FIG. 15) through which a rigid member 204 extends to resist deformation of lift handle 184 during lifting of vacuum cleaner 102. Rigid member 204 provides support to lift handle 184 and enables lift handle 184 to at least partially retain its shape when the operator grasps lift handle 184. Accordingly, rigid member 204 allows the weight of vacuum cleaner 102 to be distributed throughout the operator's hand and decreases pressure points on the hand. Lift handle 184 also includes an outer cover 216. Outer cover 216 may be a polymer and may be co-molded onto strap 186. In other embodiments, outer cover 216 is eliminated.

Figure 13:
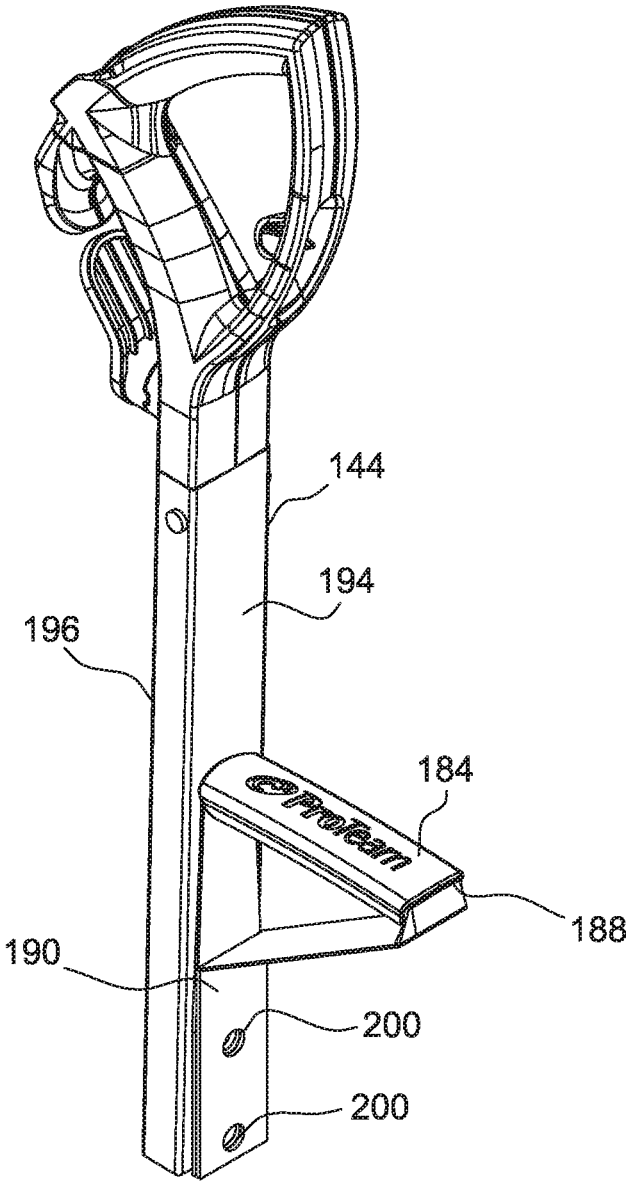
FIG. 13 is a perspective view of the handle assembly of the vacuum cleaner.
Figure 14:
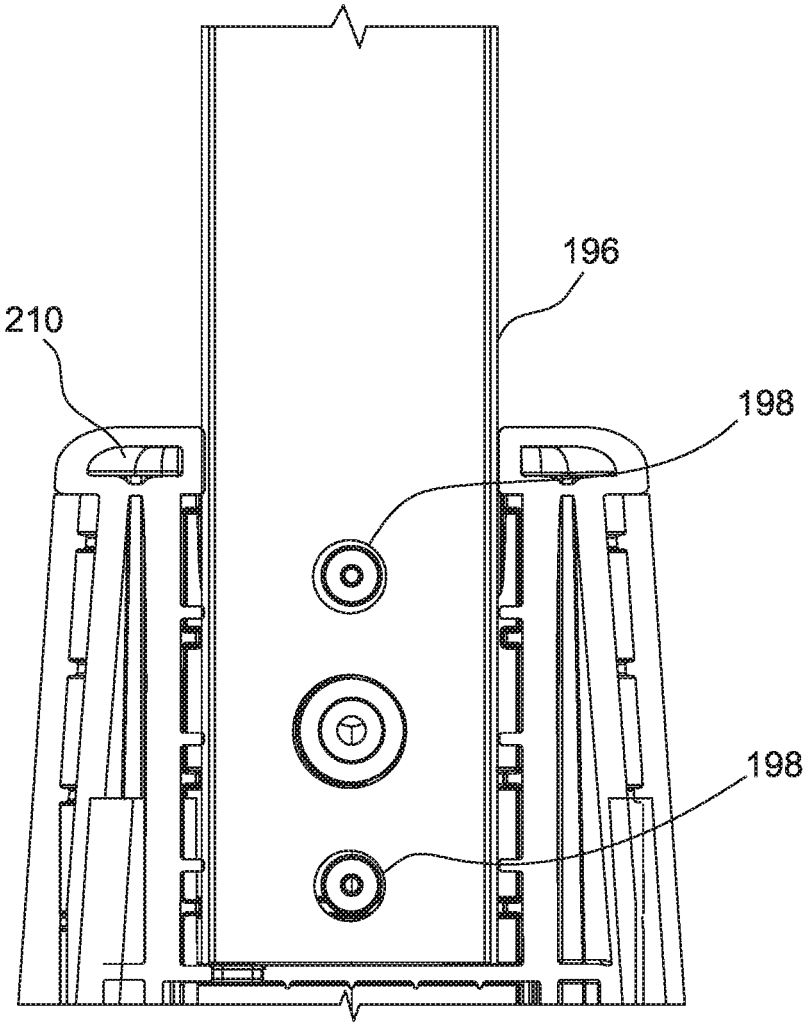
FIG. 14 is a cross-section rear view of the handle assembly.
Figure 15:
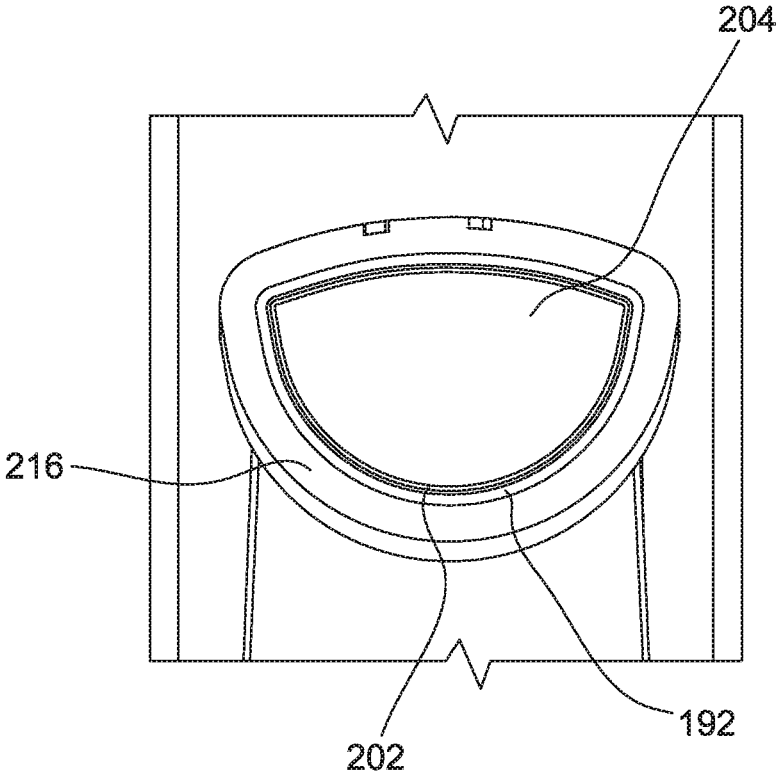
FIG. 15 is a cross-section of the lift handle showing the sleeve, rigid member and outer cover.

Lift handle 184 is adapted to be grasped by hand by an operator and should be distinguished from a shoulder strap. The operator grasps outer cover 216 of lift handle 184 by hand while lift handle is at the resting position (FIG. 12). Upon lifting, lift handle 184 pivots upward until outer cover 216 and strap sleeve 192 are generally horizontal (FIG. 13). When lifting vacuum cleaner 102, lift handle 184 may abut handle assembly shaft 196 of handle assembly 144.

Figure 4:
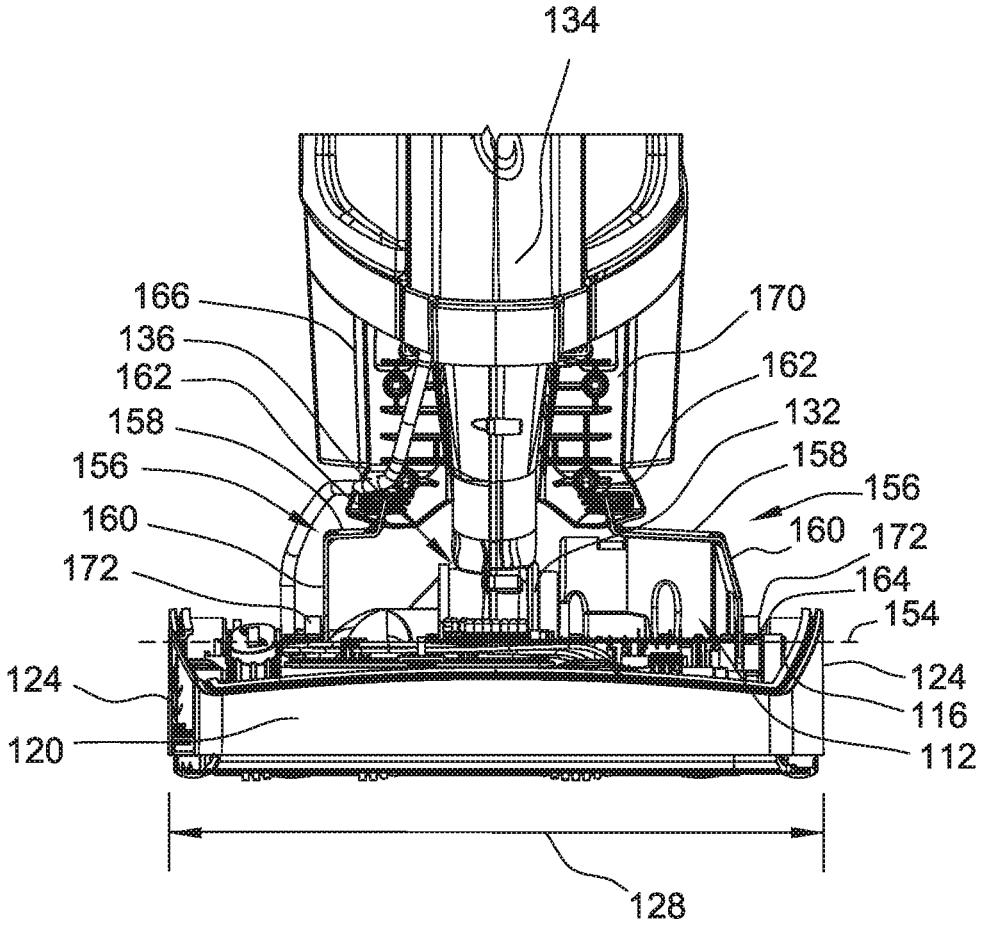
FIG. 4 is a front view of the cleaning head with the cover removed.

As shown in FIG. 4, hinge 136 pivotably attaches debris tube 134 to cleaning head 108. In particular, hinge 136 connects blower housing 132 and debris tube 134 such that air and debris may flow from blower housing 132 through hinge 136 into debris tube 134. Hinge 136 allows debris tube 134 to rotate relative to cleaning head 108 about a rotation or pivot axis 154. In some embodiments, debris tube 134 may be locked at certain rotation positions. For example, an operator may lock debris tube 134 in a vertical position when vacuum cleaner 102 is stored. The operator may unlock debris tube 134 to allow debris tube 134 to freely rotate relative to cleaning head 108 during operation. In alternative embodiments, debris tube 134 may rotate in any suitable manner.

Braces, broadly brackets, 156 extend from cleaning head 108 on opposite sides of debris tube 134. As used herein, the term "brace" refers to a support device. In particular, in this embodiment, braces 156 support debris tube 134. Braces 156 extend from debris tube 134 downward and towards sidewalls 124. A first brace 156 is connected to a motor side of cleaning head 108 and a second brace 156 is connected to a duct side of cleaning head 108.

Figure 5:
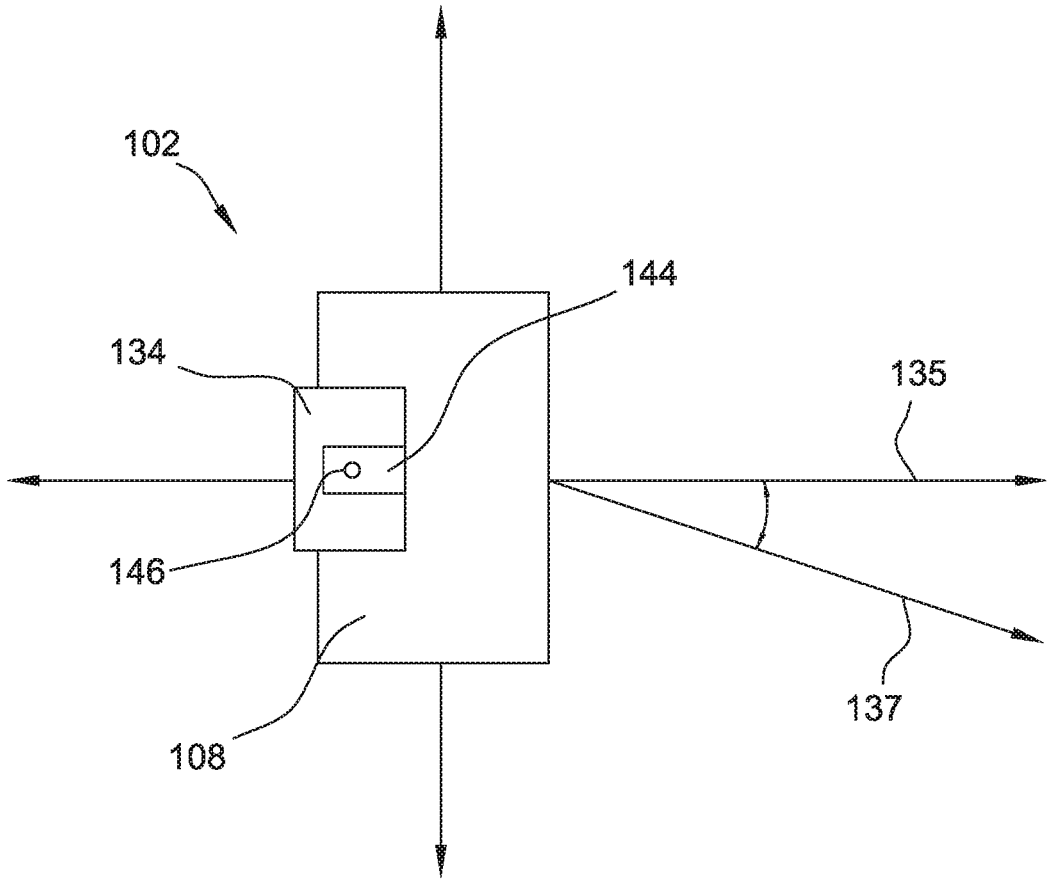
FIG. 5 is a schematic plan view of movement of the vacuum cleaner.
Figure 8:
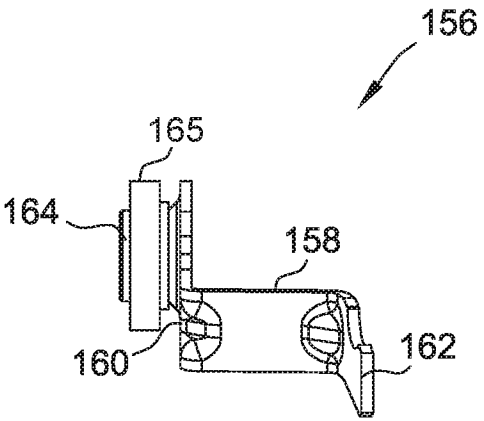
FIG. 8 is a top view of the brace shown in FIG. 6.
Figure 7:
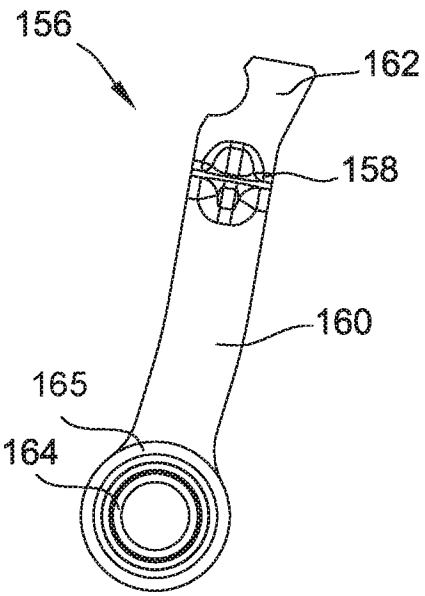
FIG. 7 is a side view of the brace shown in FIG. 6.

In reference to FIG. 5, during operation, a user may maneuver vacuum cleaner 102 using handle assembly 144. For example, a user may move vacuum cleaner 102 in a forward or backward direction 135 or the user may move vacuum cleaner 102 in a direction 137 at an angle with forward direction 135. Accordingly, during operation, the vacuum loads or load vectors in multiple directions may be transferred through handle assembly 144 and debris tube to hinge 136. Braces 156 may receive at least a portion of these loads to provide stability to vacuum cleaner 102 and reduce wear on hinge 136. Referring now to FIGS. 6-11, each brace 156 includes a horizontal bar 158, a vertical bar 160, a tab 162, and a bearing mounting flange 164. Horizontal bar 158 and vertical bar 160 are connected together at an elbow such that braces 156 have an L-shape. In this embodiment, horizontal bar 158 and vertical bar 160 are perpendicular to each other. Tab 162 extends from horizontal bar 158 at an angle. In other embodiments, braces 156 may have any shape that enables braces 156 to function as described.

Braces 156 are aligned with and extend along a drive axis of motor assembly 112 and are rotatably supported by bearings 165 (shown in FIG. 3). Accordingly, motor-side brace 156 and duct-side brace 156 may rotate relative to cleaning head 108 about rotation axis 154 (shown in FIG. 4). Bearing 165 of motor-side brace 156 extends annularly between motor-side brace 156 and drive shaft 116 to allow motor-side brace 156 and drive shaft 116 to rotate relative to each other. In this embodiment, bearings 165 include cylindrical races and ball bearings. Bearings 165 allow cleaning head 108 to have a compact size because bearings 165 are internal to braces 156. In other embodiments, braces 156 may have any bearings 164 that enable braces 156 to function as described.

In this embodiment, braces 156 are metal. In other embodiments, braces 156 may be any materials that enable braces 156 to function as described. For example, in some embodiments, braces 156 may be plastic, metal, and combinations thereof.

With reference to FIG. 4, braces 156 extend from a housing 110 of cleaning head 108 alongside debris tube 134. Each horizontal bar 158 is connected to debris tube 134 by a clamp 166 that surrounds debris tube 134. Clamp 166 includes a front plate 168 (shown in FIG. 3) and a rear plate 170 that are fastened together. Front plate 168 and rear plate 170 secure tabs 162 of braces 156 therebetween. Each vertical bar 160 is connected to cleaning head 108 by a clamp 172. Clamp 172 includes a curved portion extending over bearing mounting flanges 164 and bearings 165. Fasteners extend through clamp 172 on opposite sides of the curved portion to secure clamp 172 and vertical bar 160 to cleaning head 108. In alternative embodiments, braces 156 may be secured to debris tube 134 and cleaning head 108 in any manner that enables vacuum cleaner 102 to operate as described.

Figure 6:
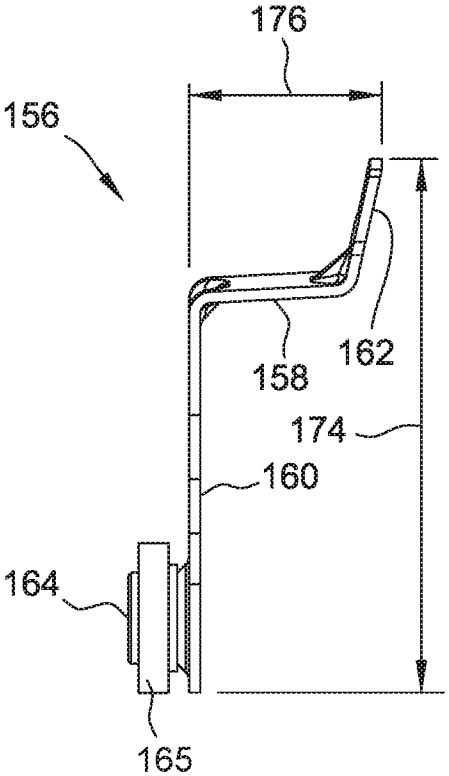
FIG. 6 is a front view of a brace for connecting to a duct-side of the cleaning head shown in FIG. 3.
Figure 11:
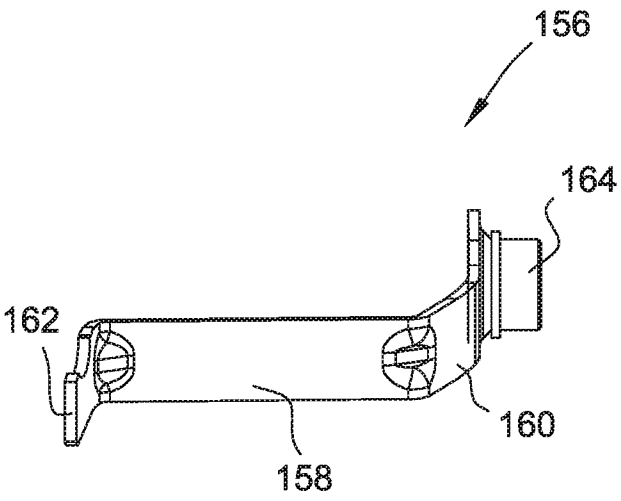
FIG. 11 is a top view of the brace shown in FIG. 9.
Figure 10:
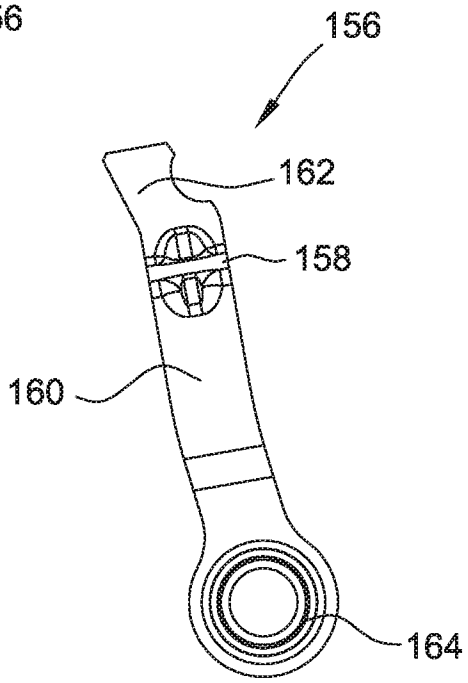
FIG. 10 is a side view of the brace shown in FIG. 9.
Figure 9:
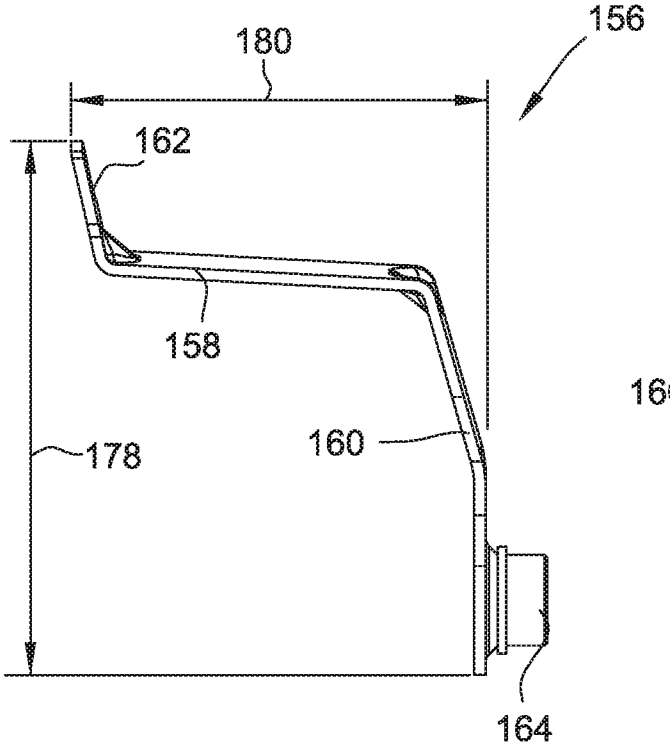
FIG. 9 is a front view of a brace for connecting to a motor-side of the cleaning head shown in FIG. 3.

In reference to FIG. 6, duct-side brace 156 has a height 174 and a length 176. In reference to FIG. 9, motor-side brace 156 has a height 178 and a length 180. In this embodiment, length 180 is greater than length 176 to allow motor-side brace 156 to extend over motor assembly 112. In addition, the size of motor-side brace 156 and duct-side brace 156 allows braces 156 to support debris tube 134 and maintain the compact size of cleaning head 108. For example, in this embodiment, the braces 156 are a sufficient size to attach to debris tube 134 and provide stabilization against loads in multiple directions on debris tube 134. In other embodiments, braces 156 may be any sizes that enable braces 156 to function as described.

As shown in FIGS. 1 and 2, battery 104 may be releasably attached to and supported by a battery support plate 182. Battery support plate 182 is attached to and extends from debris tube 134. Accordingly, debris tube 134 supports the weight of battery 104 during operation of vacuum cleaner 102. Braces 156 provide support to debris tube 134 and may carry at least a portion of the weight of battery 104. In other embodiments, battery 104 may be connected to vacuum cleaner 102 in any manner that enables vacuum cleaner 102 to operate as described.

Compared to conventional vacuum cleaning systems, the vacuum cleaning systems of embodiments of the present disclosure have several advantages. For example, embodiments of the upright vacuum cleaner include support braces to support a debris tube as the debris tube pivots relative to a cleaning head. The support braces extend along a motor axis and are connected to a motor shaft by bearings. Accordingly, the support braces allow the vacuum cleaner to be compact. In addition, the support braces allow the vacuum cleaner to maintain stability and maneuverability when the vacuum cleaner carries additional weight, such as the weight of a removable battery. Moreover, the support braces may increase the useful life of the vacuum cleaner because the support braces reduce wear on the hinge and reduce fatigue and impact fractures of the hinge.

In embodiments in which the vacuum cleaner includes a lift handle, the lift handle allows the vacuum cleaner to be more easily lifted by the operator, such as to place the vacuum cleaner on a movable cart (e.g., cleaning cart). In embodiments in which the lift handle is disposed below a steering handle, the lift handle may be at a height that more easily allows the operator to lift the vacuum cleaner. By using a flexible strap, the lift handle may be more easily grasped and maneuvered by the operator during lifting. In embodiments in which an outer cover is included in the lift handle, the outer cover may be composed of a relatively soft and/or deformable material for operator comfort (e.g., for repeated lifting of the vacuum cleaner such as during commercial cleaning operations). By including a rigid member within a sleeve of the strap, the lift member includes a rigid elongated portion which may be grasped by the operator to lift the vacuum cleaner.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. An upright vacuum cleaner comprising:

a cleaning head for removing debris from a floor;

a motor including a drive shaft defining a drive axis;

a debris tube connected to the cleaning head for receiving the debris;

a steering handle connected to the debris tube;

a hinge connecting the debris tube to the cleaning head such that the debris tube rotates relative to the cleaning head; and braces to support the debris tube as the debris tube rotates relative to the cleaning head, the braces disposed on opposite sides of the debris tube, wherein each brace is attached to the cleaning head at a first end of the brace spaced laterally outward from the hinge, and is attached to the debris tube at a second end of the brace spaced above the cleaning head, wherein the first end includes a bearing connected to the cleaning head and disposed coaxially with the drive axis to allow each brace to rotate about the drive axis.

2. The upright vacuum cleaner of claim 1, wherein the braces include a motor-side brace and a duct-side brace, the bearing of the motor-side brace being connected to a shaft of the motor.

3. The upright vacuum cleaner of claim 2, wherein the motor-side brace is longer than the duct-side brace to allow the motor-side brace to extend over the motor.

4. The upright vacuum cleaner of claim 1, wherein the cleaning head includes a housing including sidewalls, the hinge being centered between the sidewalls.

5. The upright vacuum cleaner of claim 4, wherein the braces extend from the debris tube towards the sidewalls.

6. The upright vacuum cleaner of claim 1, wherein each brace includes a horizontal bar and a vertical bar together forming an L-shape.

7. The upright vacuum cleaner of claim 6, wherein the horizontal bar is connected to the debris tube and the vertical bar is connected to the cleaning head.

8. The upright vacuum cleaner of claim 1 further comprising first clamps connecting the braces to the debris tube.

9. The upright vacuum cleaner of claim 8 further comprising second clamps connecting the braces to the cleaning head.

10. The upright vacuum cleaner of claim 1 further comprising:

a lift handle for lifting the vacuum cleaner from the floor, the lift handle comprising:

a flexible strap comprising a sleeve that defines a channel within the sleeve; and a rigid member that extends through channel.

11. The upright vacuum cleaner of claim 10 wherein the lift handle comprises a deformable outer cover, the sleeve being disposed between the outer cover and the rigid member.

12. The upright vacuum cleaner of claim 10 wherein the strap comprises a leg and a loop that extends from the leg, the loop comprising the strap sleeve.

13. The upright vacuum cleaner of claim 12 further comprising:

a filter assembly to filter and collect debris from an airstream, wherein the debris tube is connected to the filter assembly; and a filter housing, the filter assembly being disposed within the filter housing, the strap loop being disposed between the steering handle and the filter housing.

14. The upright vacuum cleaner of claim 10 wherein the lift handle is disposed below the steering handle.

15. The upright vacuum cleaner of claim 10 wherein the steering handle extends from a shaft of a handle assembly, the strap being fastened to the shaft.

16. The upright vacuum cleaner of claim 10 wherein the upright vacuum cleaner does not include a shoulder strap.

17. The upright vacuum cleaner of claim 10 wherein the strap is made of at least one of nylon, leather, canvas, and polyester.

* * * * *